US006110308A

United States Patent [19]

Ewald et al.

[11] Patent Number: 6,110,308

[45] Date of Patent: Aug. 29, 2000

[54] EXPLOSIVES PRODUCED FROM SALVAGED EXPLOSIVE MATERIALS

[75] Inventors: Gerhard Ewald; Wilhelm Behlert, both of Haltern, Germany

[73] Assignee: Wasagchemie Sythen GmbH, Haltern, Germany

[21] Appl. No.: 09/284,941

[22] PCT Filed: Apr. 30, 1998

[86] PCT No.: PCT/EP97/05844

§ 371 Date: Jun. 28, 1999

§ 102(e) Date: Jun. 28, 1999

[87] PCT Pub. No.: WO98/17605

PCT Pub. Date: Apr. 30, 1998

[30] Foreign Application Priority Data

Oct. 23, 1996 [DE] Germany ..... 196 43 772

[51] Int. Cl.[7] ..... D03D 23/00; C06B 25/34; C06B 31/28; C06B 45/10

[52] U.S. Cl. ..... 149/109.6; 149/19.92; 149/124; 149/46; 149/92

[58] Field of Search ..... 149/109.6, 19.92, 149/124, 46, 92; 264/3.1

[56] References Cited

U.S. PATENT DOCUMENTS

| | | | |
|---|---|---|---|
| 4,038,116 | 7/1977 | Andrews et al. | 149/105 |
| 4,098,627 | 7/1978 | Tompa et al. | 149/109.6 |
| 4,389,265 | 6/1983 | Tompa et al. | 149/109.6 |
| 5,284,995 | 2/1994 | Melvin | 528/203 |
| 5,370,845 | 12/1994 | Miller et al. | 422/186.3 |
| 5,445,690 | 8/1995 | Wulfman | 149/109.6 |

FOREIGN PATENT DOCUMENTS

| | | | |
|---|---|---|---|
| 4237580C1 | 3/1994 | Germany | F24D 5/04 |
| 94/00406 | 1/1994 | WIPO | C06B 47/14 |
| 96/23196 | 8/1996 | WIPO | F42D 5/04 |

OTHER PUBLICATIONS

Chemical Abstracts, vol. 125, No. 10, Sep. 2, 1996, Columbus, Ohio, U.S.; Abstract No. 118901x, R. Pan et al., "Study of the New Method for Waste Gun Propellants Reuse. Manufacturing of Powder Explosives".

Chemical Abstracts, vol. 125, No. 18, Oct. 28, 1996, Columbus, ohio, U.S.; Abstract No. 2259494r, T. Dosoudil et al.: "Remaking and re–using of Double Base Large Caliber Powders to be Used as Industrial Explosives".

*Primary Examiner*—Charles T. Jordan
*Assistant Examiner*—Aileen J. Baker
*Attorney, Agent, or Firm*—Allen, Dyer, Doppelt, Milbrath & Gilchrist, P.A.

[57] ABSTRACT

In a process for the manufacture of explosives from old explosive materials, especially from cyclonite or mixtures containing cyclonite, wherein the old explosive materials are wetted with an organic solvent and transformed into a crumbly mass, the crumbly mass is directly fed into a mixer in which it is mixed with at least an inorganic nitrate and in the process dried into the finished explosive through evaporation of the solvent.

17 Claims, 1 Drawing Sheet

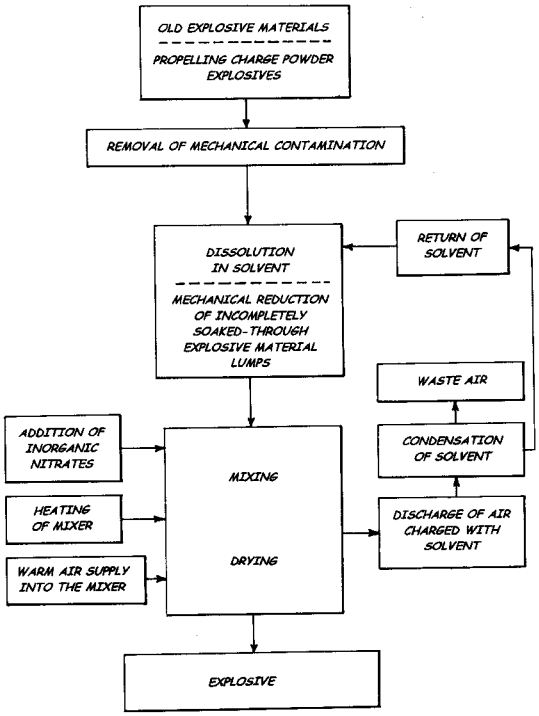

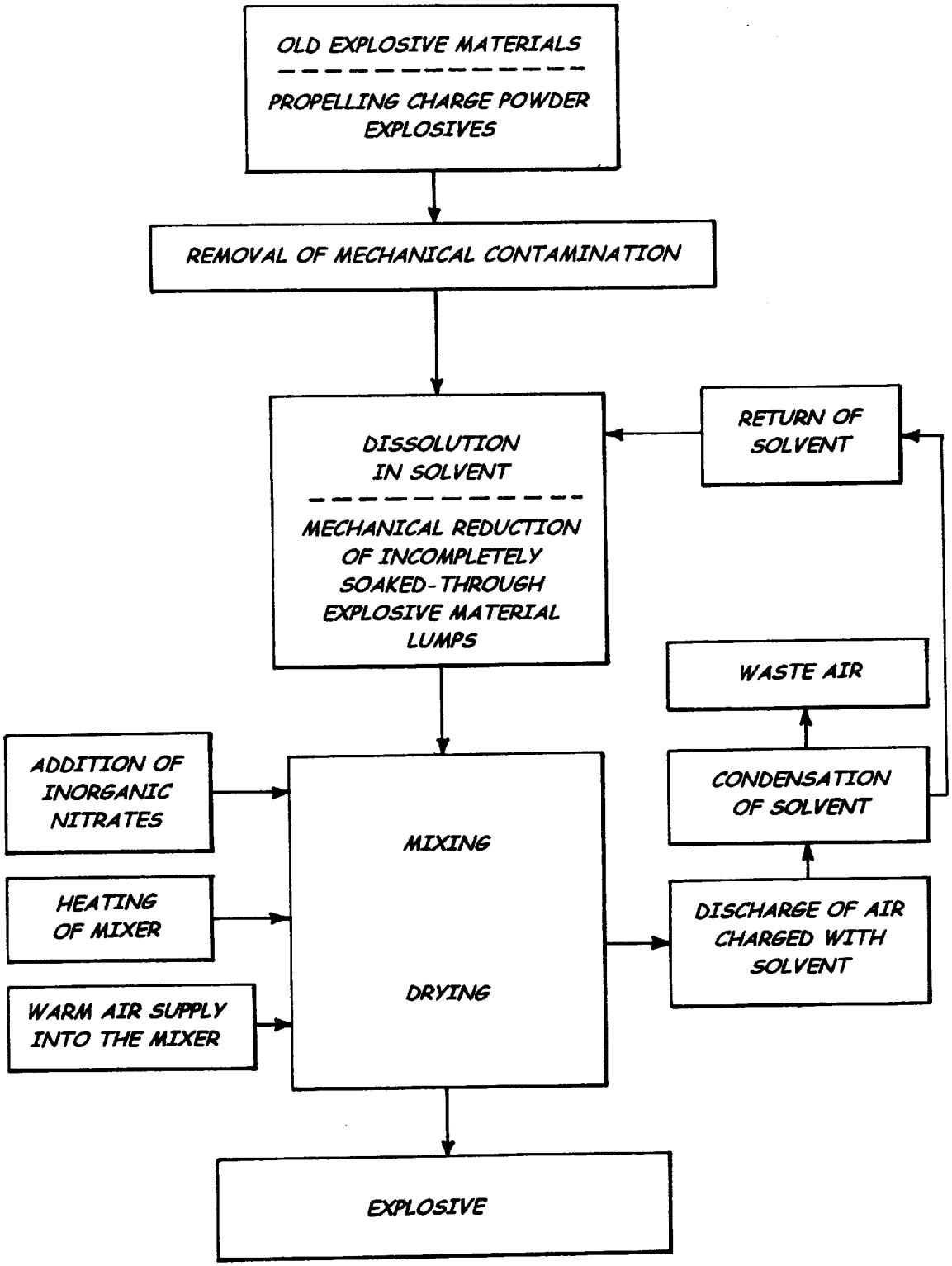
OLD EXPLOSIVE MATERIALS
PROPELLING CHARGE POWDER EXPLOSIVES
REMOVAL OF MECHANICAL CONTAMINATION
DISSOLUTION IN SOLVENT
MECHANICAL REDUCTION OF INCOMPLETELY SOAKED-THROUGH EXPLOSIVE MATERIAL LUMPS
RETURN OF SOLVENT
WASTE AIR
CONDENSATION OF SOLVENT
ADDITION OF INORGANIC NITRATES
HEATING OF MIXER
WARM AIR SUPPLY INTO THE MIXER
MIXING
DRYING
DISCHARGE OF AIR CHARGED WITH SOLVENT
EXPLOSIVE

EXPLOSIVES PRODUCED FROM SALVAGED EXPLOSIVE MATERIALS

FIELD OF THE INVENTION

The present invention relates to the field of a process for the manufacture of explosives from old explosive materials, especially from cyclonite or mixtures containing cyclonite, in which the old explosive materials are wetted with an organic solvent and transformed into a crumbly or doughy mass.

BACKGROUND OF THE INVENTION

Political development in recent years has resulted in a strong increase in munitions requiring delaboration. The propelling charge powder and explosives obtained can be disposed of by burning or detonating without further treatment. However, the resulting environmental impact through the formation of larger quantities of carbon dioxide ($CO_2$) and nitric oxides ($NO_X$), dust and noise or the costs for their reduction, are considerable. In order to increase the ecologically beneficial aspects and the economy of the disposal of delaborated explosives, a number of processes have been suggested whose aim is the utilization of at least some explosive material components.

In DE 41 38 733 A1 for instance it is suggested to dissolve delaboration TNT in a solvent and to add this solvent to a fuel. In this way the TNT is being utilized but ultimately still combusted with the resulting disadvantages.

Combustion is also provided for according to DE 42 23 415 C1. The explosive material is dissolved in a liquid, combustible solvent, insoluble foreign materials are removed from the solution and the cleaned, saturated solution finally fed into a combustion chamber.

A process and a device are known from DE 42 37 580 C1 which can be used to reduce the wax content of an explosive material and its grain size. The finely crystalline explosive material can be used for the manufacture of propelling charge powders or permissible explosives. The wax-enriched residue can also be utilized for the manufacture of an explosive by combining it with porous ammonium nitrate prills. The separation into individual components required with this process and the recrystallization of the explosive material however require considerable expenditure in terms of machines and time.

SUMMARY OF THE INVENTION

In contrast with this, the task of the present invention consists of improving a process in accordance with this category so that explosives can be manufactured faster and easier from old explosive materials.

In accordance with the invention this task is solved with a process of the type mentioned at the outset in that the crumbly mass is directly fed into a mixer in which it is mixed with at least an inorganic nitrate while being dried into the finished explosive through evaporation of the solvent.

The process according to the invention permits disposal of old explosive materials, especially explosive materials containing cyclonite from delaborated ammunition and old propelling charge powder in an ecologically beneficial and economical manner. Since the old explosive materials treated with an organic solvent are transformed into a crumbly or doughy mass which can be handled safely and arrives in a mixer in this form where it is mixed with an inorganic nitrate and dried into a finished explosive, no additional intermediate operations and intermediate products whatsoever are incurred. The components of the dissolved old explosive material are merely complemented to form a new explosive by adding inorganic nitrate which can especially be used also for civilian purposes. No mechanical installations for the separation and further processing of individual components of the old explosive material are required.

Acetone is preferably used as a solvent. In order to accelerate the initial dissolution and penetration with moisture of the usually fist-sized explosive material lumps into a crumbly mass, mechanical crushing of explosive material lumps as yet incompletely moistened through can be provided.

In an advantageous embodiment of the invention the inorganic nitrates predominantly contain ammonium nitrate. It is also possible to exclusively add ammonium nitrate to the crumbly mass.

The inorganic nitrates are preferably mixed in ground form or as granulate. Since the inorganic nitrate does not loose its shape during the mixing process and the powder or the granulate or the prills are only loaded with the explosive materials during the mixing process after the evaporation of the solvent it is possible without additional effort to optionally manufacture powdery explosive or granulate explosive.

The solvent is preferably evaporated by heating the mixer.

In order to accelerate the evaporation process it is possible to direct a warm air jet into the mixer onto the moving surface of the material to be mixed.

In a favorable embodiment of the invention the air charged with acetone vapor is discharged from the mixer and directed through a condenser and a cooling trap in order to condense the acetone and the reclaimed acetone is returned into the manufacturing process. In this way the costs can be lowered considerably.

It is an advantage if a weak vacuum is applied to the mixer towards the end of the mixing process. With this action it is possible to rapidly extract residual solvent vapors from the mixer via the condensation system.

BRIEF DESCRIPTION OF THE DRAWINGS

The invention will still be explained in more detail by means of the single drawing on the example of a flow diagram.

DETAILED DESCRIPTION OF PREFERRED EMBODIMENTS

In the examples described further down the process according to the invention was applied to monobasic and polybasic old propelling charge powder and explosives or explosive mixtures with the composition of cyclonite/phlegmatizing agent, designated as A IX-1, and cyclonite/aluminum/phlegmatizing agent designated as A IX-2. The process according to the invention however is by no means restricted to these explosive material groups but also applicable to others such as explosive materials containing TNT/cyclonite/aluminum/phlegmatizing agent.

Wax served as phlegmatizing agent in all above mentioned explosive materials. The propelling charge powder and explosives consisted of rough piece material, i.e. fist-sized lumps. Mechanical contamination such as plastic, metal, paper, etc., had been removed on a sorting table. The explosive material lumps were placed in drums and wetted with acetone. The drums were closed and put aside until the lumps decomposed into a crumbly mass, i.e. approximately 8 hours to several days. In order to intensify the dissolution process the drums were turned for a short time. After some days the drums were re-opened. The original pressed shape of the lumps was now completely destroyed.

In order to reduce explosive material lumps not yet thoroughly soaked through, the moist crumbly mass was passed through a circular sieve with rotating cross and scrapers. In this way it is possible to remove any mechanical contamination remaining in the explosive material. If it has already been ascertained that the explosive material is free of such contamination the explosive material lumps not yet thoroughly soaked through can also be reduced on a rubber-lined roller mill.

The crumbly or highly viscous doughy mass was now placed into a heatable mixer and inorganic nitrates, in the present examples, ammonium nitrate, added. While mixing the mixer contents were warmed up in order to evaporate the acetone. During this process a warm air jet was directed into the mixer onto the moving surface of the material to be mixed in order to accelerate the evaporation process. The warm air charged with the acetone vapor was discharged from the mixture and directed through a condenser and a cooling trap in this way condensing the acetone. The reclaimed acetone was reused for wetting the explosive material lumps, i.e. the old propelling charge powder and the old explosives or old explosive mixtures in the drums.

In some of the examples the ammonium nitrate was added in ground form, in others as granulate or prills. Depending on the shape of the admixed ammonium nitrate, the finished explosive was available as powder or granulate after evaporation of the acetone.

When using old propelling charge powders as basic explosive material, only ammonium nitrate in ground form was preferably used since the old propelling charge powder/ammonium nitrate mixture develops into granulate shape anyhow. The finished explosive is therefore obtained as granulate in this case and can be manufactured in different grain sizes through fractionated sieving.

By varying the quantity ratios of old explosive material/inorganic nitrate, a wide band width of technical explosion performance is obtained while a cap-sensitive explosive capable of flowing is manufactured. Some examples are presented in the following.

EXAMPLE 1

A polybasic old propelling charge powder with the composition =28% nitrocellulose, =23% nitroglycerine, =47% nitroguanidine as well as =2% stabilizers and additives. The new explosive mixtures contained 18% of this old propelling charge powder and 82% of finely crystalline ammonium nitrate. The new explosive was formed as a granulate with grain sizes <4 mm having the following technical blasting data:

transmission (32 mm ø) 5 cm, lead block bulging (Trauzl) 300 $cm^3$, detonating velocity (exposed, 32 mm ø) 3600 m/sec.

EXAMPLE 2

A polybasic old propelling charge powder I of the composition given in Example 1 and a monobasic old propelling charge powder II with =96% nitrocellulose as well as =4% stabilizers and additives served as basic materials. The new explosive mixture contained 18% old propelling charge powder I, 18% old propelling charge powder II as well as 64% of finely crystalline ammonium nitrate. The new explosive was in the shape of a granulate with a grain size <4 mm having the following technical blasting data:

Transmission (32 mm ø) 5 cm, lead block bulging (Trauzl) 260 $cm^3$, detonating velocity (exposed, 32 mm ø) 1900 m/sec.

EXAMPLE 3

An explosive A IX-1 with =94% cyclonite and 6% wax as phlegmatizing agent served as basic material. The new explosive mixture contained 42% A IX-1 and 58% powdery ammonium nitrate. The new explosive was in form of powder and had the following technical blasting data:

Transmission (30 mm ø) <5 cm, lead block bulging (Trauzl) 410 $cm^3$, detonating velocity (exposed, 30 mm ø) 5300 m/sec.

EXAMPLE 4

An explosive A IX-1 described in Example 3 served as basic material. The new explosive mixture contained 28% A IX-1 and 72% ammonium nitrate in granular form. The new explosive was in form of a granulate having the following technical blasting data:

Lead block bulging (Trauzl) 280 $cm^3$.

EXAMPLE 5

An explosive A IX-2 with the composition =73% cyclonite, =23% aluminum powder and 4% wax as phlegmatizing agent served as basic material. The new explosive mixture contain 36% A IX-2 and 64% powdery ammonium nitrate. The new explosive was in powder form having the following technical blasting data:

Transmission (30 mm ø) >5 cm, lead block bulging (Trauzl) 440 $cm^3$, detonating velocity (exposed 30 mm ø) 4200 m/sec.

EXAMPLE 6

An explosive A IX-2 in the composition specified in Example 5 served as basic material. The new explosive mixture contained 12% A IX-2 and 88% ammonium nitrate in granular form. The new explosive was in form of a granulate having the following technical blasting data:

Transmission (30 mm ø) >2 cm, lead block bulging (Trauzl) 370 $cm^3$, detonating velocity (exposed 30 mm ø) 3600 m/sec.

What is claimed is:

1. A process for the manufacture of explosives from old explosive materials, wherein the old explosive materials are wetted with an organic solvent and transformed into a crumbly mass, characterized in that the crumbly mass is directly fed into a mixer in which it is mixed with at least an inorganic nitrate and in the process dried into a finished explosive by evaporating the organic solvent.

2. A process according to claim 1, wherein acetone is used as the solvent.

3. A process according to claim 1, wherein the old explosive material lumps not yet thoroughly soaked through are mechanically reduced after initial dissolution into a doughy mass.

4. A process according to claim 1, wherein ammonium nitrate is employed as an inorganic nitrate.

5. A process according to claim 4, wherein the inorganic nitrate is admixed in ground or granular form.

6. A process according to claim 1, wherein the mixer is heated.

7. A process according to claim 6, wherein a warm jet of air is directed onto the moving surface of the material to be mixed within the mixer.

8. A process according to claim 2, wherein the air is charged with acetone vapor and the charged air is discharged from the mixer and directed through a condenser and a cooling trap in order to condense the acetone, and wherein the reclaimed acetone is returned to the manufacturing process.

9. A process according to claim 8, wherein a weak vacuum is applied to the mixer towards the end of the mixing process and the residual solvent is extracted via the condenser.

10. A process for manufacturing explosives from old explosive materials, the old explosive materials including cyclonite, the process comprising the steps of wetting the old explosive materials with an organic solvent to thereby transform the wetted explosive materials into a crumbly mass, directly feeding the crumbly mass into a heated mixer, mixing the crumbly mass with at least an inorganic nitrate, and drying the mixed crumbly mass into a finished explosive by evaporating the organic solvent.

11. A process according to claim 11, wherein the organic solvent comprises acetone.

12. A process according to claim 11, wherein the old explosive material lumps not yet thoroughly soaked through are mechanically reduced after initial dissolution into a doughy mass.

13. A process according to claim 12, wherein the inorganic nitrate comprises ammonium nitrate.

14. A process according to claim 13, wherein the inorganic nitrate is mixed in ground or granular form.

15. A process according to claim 14, wherein a warm jet of air is directed onto the moving surface of the material to be mixed within the mixer.

16. A process according to claim 15, wherein the air is charged with acetone vapor and the charged air is discharged from the mixer and directed through a condenser and a cooling trap in order to condense the acetone, and wherein reclaimed acetone is returned to the manufacturing process.

17. A process according to claim 16, wherein a weak vacuum is applied to the mixer during an end portion of time of the mixing process, and wherein the residual solvent is extracted via the condenser.

* * * * *

UNITED STATES PATENT AND TRADEMARK OFFICE

CERTIFICATE OF CORRECTION

PATENT NO. : 6,110,308
DATED : August 29, 2000
INVENTOR(S) : EWALD ET AL..

It is certified that error appears in the above-identified patent and that said Letters Patent is hereby corrected as shown below:

On the title page; Delete "Apr.30, 1998" and insert Section [22] --October 22, 1997-- therefor.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*